US008529382B2

(12) United States Patent
Green et al.

(10) Patent No.: US 8,529,382 B2
(45) Date of Patent: Sep. 10, 2013

(54) BASEBALL PITCHING SIMULATOR

(76) Inventors: Everett L. Green, Shreveport, LA (US); Robert R. Poland, III, Bossier City, LA (US)

( * ) Notice: Subject to any disclaimer, the term of this patent is extended or adjusted under 35 U.S.C. 154(b) by 54 days.

(21) Appl. No.: 13/328,221

(22) Filed: Dec. 16, 2011

(65) Prior Publication Data

US 2013/0157787 A1 Jun. 20, 2013

(51) Int. Cl.
*A63F 13/00* (2006.01)

(52) U.S. Cl.
USPC ..... 473/454; 473/455; 273/317.6

(58) Field of Classification Search
USPC ..... 473/454, 455, 456; 273/317.6, 331
See application file for complete search history.

(56) References Cited

U.S. PATENT DOCUMENTS

| | | | | |
|---|---|---|---|---|
| 4,210,326 | A | 7/1980 | Booth et al. | |
| 5,348,291 | A * | 9/1994 | Scully | 473/454 |
| 5,433,434 | A * | 7/1995 | Helmetsie | 473/446 |
| 5,509,649 | A * | 4/1996 | Buhrkuhl | 473/455 |
| 5,803,841 | A * | 9/1998 | Daskoski | 473/454 |
| 6,093,120 | A * | 7/2000 | Luke, Jr. | 473/454 |
| 7,479,075 | B2 | 1/2009 | Burruss, Jr. | |
| 7,651,417 | B1 * | 1/2010 | Sims | 473/454 |
| 7,901,305 | B2 * | 3/2011 | Maeda | 473/436 |

* cited by examiner

*Primary Examiner* — James S McClellan
(74) *Attorney, Agent, or Firm* — Dale J. Ream

(57) ABSTRACT

A baseball pitching simulator includes first and second vertical support members. A first adjustment assembly includes a first carriage coupled to a first vertical support member and is movable by a pulley system and first motor. A second adjustment assembly is coupled to the first carriage and movable vertically when the first carriage is moved along the vertical support member. The second adjustment assembly includes pulleys extending laterally between the vertical support members and is coupled to a pitching target. The first and second adjustment assemblies regulate vertical and horizontal positions thereof, respectively. First and second motors actuate movement of the adjustment assemblies. The pitching target includes a pressure sensor to detect impact. The simulator includes a backstop having a vibration sensor to determine when the backstop is impacted. A processor and programming cause the adjustment assemblies to move the pitching target.

18 Claims, 8 Drawing Sheets

BASEBALL PITCHING SIMULATOR

BACKGROUND OF THE INVENTION

This invention relates generally to baseball pitching training devices and, more particularly, to a baseball pitching simulator having a horizontally and vertically movable target configured to simulate a live pitcher-hitter dual.

Regardless if a pitcher is a child, teenager, adult, amateur or professional, a pitcher routinely seeks a convenient, effective, and entertaining way to practice the art of pitching. Like most sports, pitching accuracy is improved with repetition. Pitching may be practiced by throwing to a catcher who may move his glove around so that the pitcher has a variable target. However, a live catcher may not always be available to work with the pitcher.

Various devices have been proposed in the art that provide a target at which to throw a ball. Some devices cause a ball to return to the pitcher and others cause a pitching target to return to a default position when hit. Although presumably effective for their intended purposes, the existing devices do not provide a pitching training aid that effectively simulates a real hitter-pitcher dual or that simulates practice with a live catcher who may vary the position of the catcher's mitt.

Therefore, it would be desirable to have a baseball pitching simulator that effectively simulates pitching to a live catcher. Further, it would be desirable to have a baseball pitching simulator that causes a pitching target to move both vertically and horizontally in between pitches. In addition, it would be desirable to have a baseball pitching simulator that displays an ongoing pitch count as well as the speed of the latest pitch.

SUMMARY OF THE INVENTION

A baseball pitching simulator for simulating a live pitcher-hitter dual includes a framework having first and second vertical support members. A first adjustment assembly includes a first carriage coupled to the first vertical support member and is vertically movable by a pulley system and first motor. A second adjustment assembly is coupled to the first carriage and movable vertically when the first carriage is moved up or down the vertical support member. The second adjustment assembly includes first and second pulleys extending laterally between the vertical support members and is coupled to a pitching target. Accordingly, the first adjustment assembly regulates a vertical position of the pitching member and the second adjustment assembly regulates a horizontal position thereof. First and second motors actuate movement of the adjustment assemblies. The simulator includes a pitching target having a pressure sensor to detect impact. The simulator includes a backstop and a vibration sensor to determine when the backstop is impacted. A processor and programming determine and cause the adjustment assemblies to move the pitching target.

Therefore, a general object of this invention is to provide a baseball pitching simulator for simulating a live pitcher-hitter dual.

Another object of this invention is to provide a baseball pitching simulator, as aforesaid, having a framework, movable pitching target, and a backstop that enables a user to throw a baseball toward the pitching target and that senses if the target was hit or missed.

Still another object of this invention is to provide a baseball pitching simulator, as aforesaid, that includes a pressure sensor on the pitching target and a vibration sensor on a backstop to determine where a pitched ball has impacted.

Yet another object of this invention is to provide a baseball pitching simulator, as aforesaid, that includes programming configured to actuate movement of the pitching target after each pitch.

A further object of this invention is to provide a baseball pitching simulator, as aforesaid, enabling a user to select between a mode in which the pitching target adjusts its position after every pitch and a mode in which it adjusts only after the target was hit, i.e. a "strike."

A still further object of this invention is to provide a baseball pitching simulator, as aforesaid, having a speed detection device and display screen.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
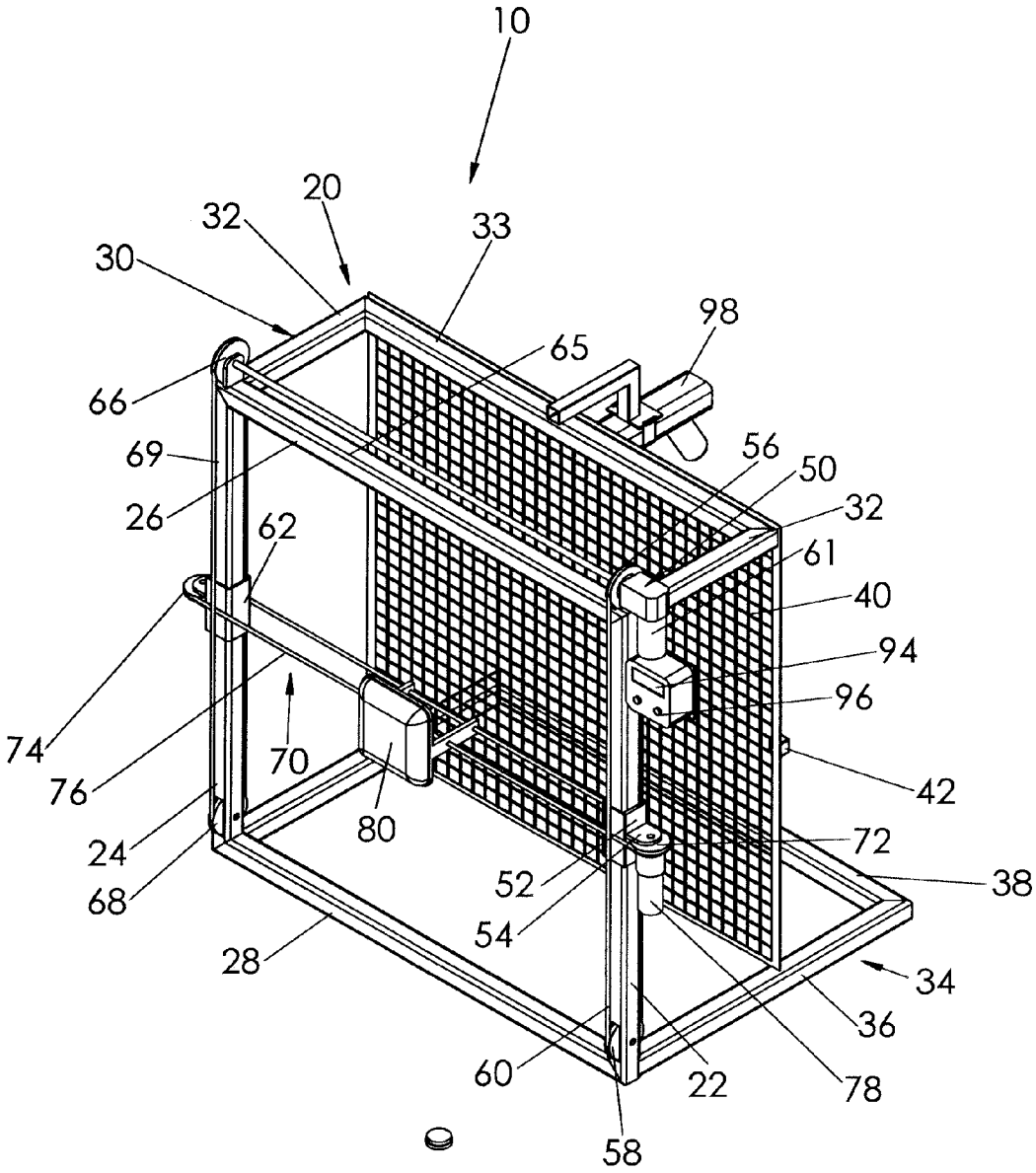
FIG. 1 is a perspective view of a baseball pitching simulator according to a preferred embodiment of the present invention.

A baseball pitching simulator according to the present invention will now be described in detail with reference to FIGS. 1 to 8 of the present invention. The baseball pitching simulator 10 includes a framework 20, a first adjustment assembly 50, a second adjustment assembly 70, a pitching target 80, a backstop 40, and sensors configured to detect when a ball impacts either the target or backstop.

Figure 2:
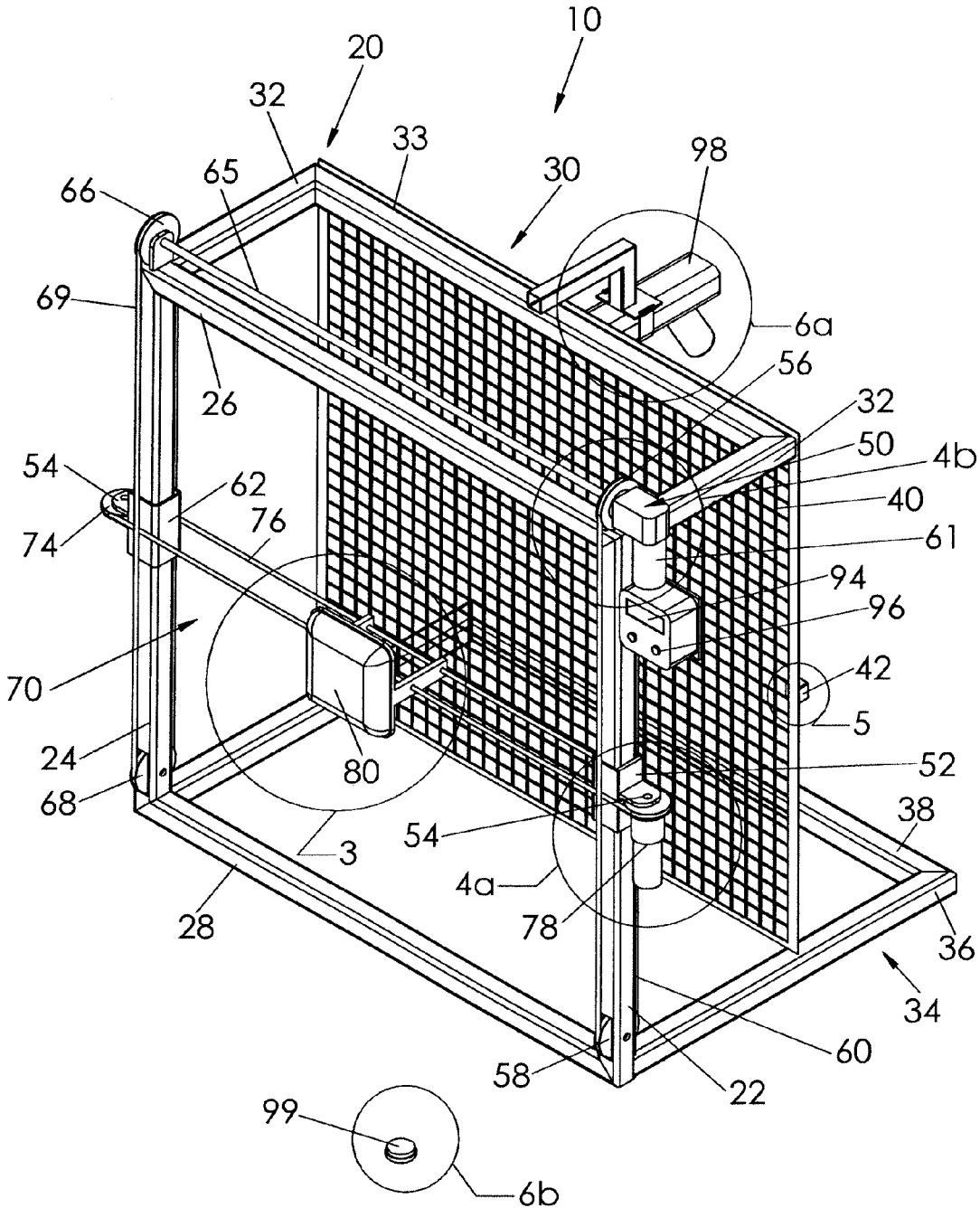
FIG. 2 is another perspective view of the baseball pitching simulator as in FIG. 1 on an enlarged scale.
Figure 3:
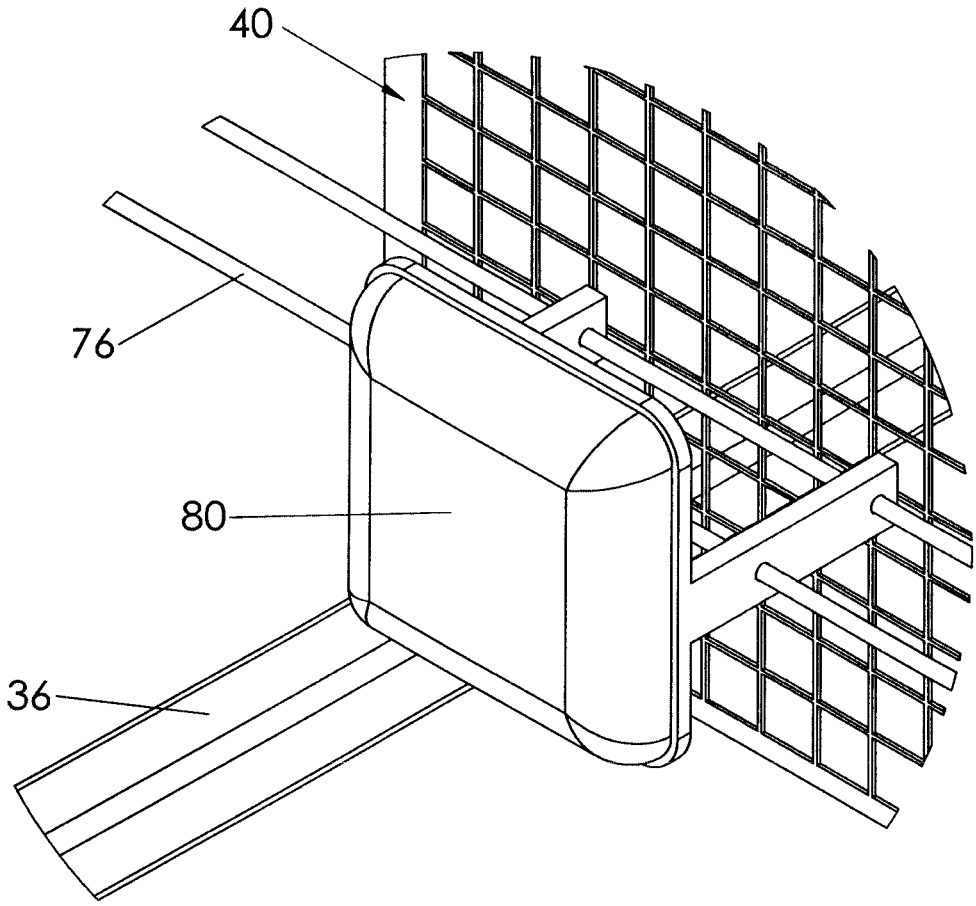
FIG. 3 is an isolated view on an enlarged scale taken from a portion of FIG. 2.

The framework 20 may include opposed first 22 and second 24 vertical support members each having respective upper and lower ends (unnumbered). An upper support member 26 may extend between respective upper ends of the first 22 and second 24 vertical support members (FIG. 2). The framework 20 may also include a lower support member 28 extending between respective lower ends of the first 22 and second 24 vertical support members. Further, an upper support structure 30 may be coupled to respective upper ends of the first 22 and second 24 vertical support members. Preferably, the upper support structure 30 includes opposed upper side bars 32 extending rearwardly from the first 22 and second 24 vertical support member upper ends with an auxiliary upper support member 33 connecting the side support bars (FIG. 2). The framework 20 may also include a lower support structure 34 having opposed lower side bars 36 extending rearwardly from lower ends of the first 22 and second 24 vertical support members. An auxiliary lower support member 38 may extend between the rearward ends of the lower side bars 36, the lower support structure 34 preferably having a profile larger than that of the upper support structure 30 so as to be stable against being tipped over in use.

The backstop 40 may include a top edge coupled to the upper support structure 30 and extend downwardly substantially adjacent to or attached to the lower support structure 34. The backstop 40 may have a flexible construction, such as a nylon net, canvas sheet, or the like.

The first adjustment assembly 50 (also referred to as the "vertical assembly") may include a first carriage 52 mounted to the first vertical support member 22 that is configured to move therealong substantially between upper and lower ends of the first vertical support member 22, as will be described below. More particularly, the first carriage 52 may be configured as a sleeve that extends about the first vertical support member 22 and is slidably movable relative thereto. The first adjustment assembly 50 may include a first motor 61 operatively connected to the first carriage 52 so as to cause the first carriage 52 to move upwardly or downwardly along the first vertical support member 22 when energized, as will be described below.

The first adjustment assembly 50 may include a pulley system connecting the first motor 61 and the first carriage 52. More particularly, the first adjustment assembly 50 may include upper 56 and lower 58 pulleys operatively mounted to respective upper and lower ends of the first vertical support member 22. The first adjustment assembly 50 may include a first cable 60 having a continuous loop construction and configured to rotate about the upper 56 and lower 58 pulleys when the pulleys are themselves rotated. Preferably, the first motor 61 is operatively coupled to the first adjustment assembly first pulley 56 so as to actuate the pulley to rotate when the first motor 61 is electrically energized. The first cable 60 is fixedly connected to the first carriage 52 so as to move the first carriage 52 upwardly or downwardly along the first vertical support member 22 when the first cable 60 is operated by rotation of the pulleys.

Alternatively, the first adjustment assembly 50 may include a track apparatus and electrical means for moving the first carriage 52 therealong (not shown) or another means for moving the first carriage 52 upwardly and downwardly along the first vertical support member 22.

The second adjustment assembly 70 (also referred to as the "horizontal assembly") has a similar pulley configuration. More particularly, the second adjustment assembly 70 includes a first pulley 72 coupled to the first adjustment assembly first carriage 52. The second adjustment assembly 70 includes a second pulley 74 that may be positioned adjacent the second vertical support member 24 opposite the first carriage 52 (or attached to a second carriage 62 as will be described later). The second adjustment assembly 70 includes a second adjustment assembly cable 76 having a continuous loop construction and extending between the second adjustment assembly first 72 and second 74 pulleys. The second adjustment assembly cable 76, therefore, extends substantially between the first 22 and second 24 vertical support members in a generally horizontal configuration. Since the second adjustment assembly first pulley 72 is coupled to the first carriage 52, the entire second adjustment assembly 70 is moved upwardly or downwardly according to a corresponding movement of the first carriage 52. The second adjustment assembly 70 includes a second motor 78 operatively connected to the second adjustment assembly first pulley 72 so as to cause it to rotate when the second motor 78 is energized.

In some embodiments, the first adjustment assembly 50 may include a second carriage 62 mounted to the second vertical support member 24 and configured for movement therealong between respective upper and lower ends. The first adjustment assembly 50 may also include auxiliary upper 66 and lower 68 pulleys operatively mounted to respective upper and lower ends of the second vertical support member 24. The auxiliary pulleys are mounted so as to rotate. An auxiliary first adjustment assembly cable 69 that includes a continuous loop construction may be operatively coupled to respective pulleys and extend therebetween in the same manner described previously. The auxiliary cable 69 is connected to the second carriage 62 so as to urge the second carriage 62 upwardly or downwardly along the second vertical support member 24 when the auxiliary pulleys are rotated. Preferably, a connector rod 65 extends between and is fixedly attached to the first adjustment assembly first pulley 56 and the auxiliary first adjustment assembly upper pulley 66 so that rotation of the first adjustment assembly upper pulley 56 causes the auxiliary first adjustment assembly first pulley 66 to rotate.

In use, therefore, operation of the corresponding first pulleys causes the first 52 and second 62 carriages to move upwardly or downwardly along respective vertical support members in unison. The second adjustment assembly second pulley 74 may be coupled to the second carriage 62.

Figure 4A:
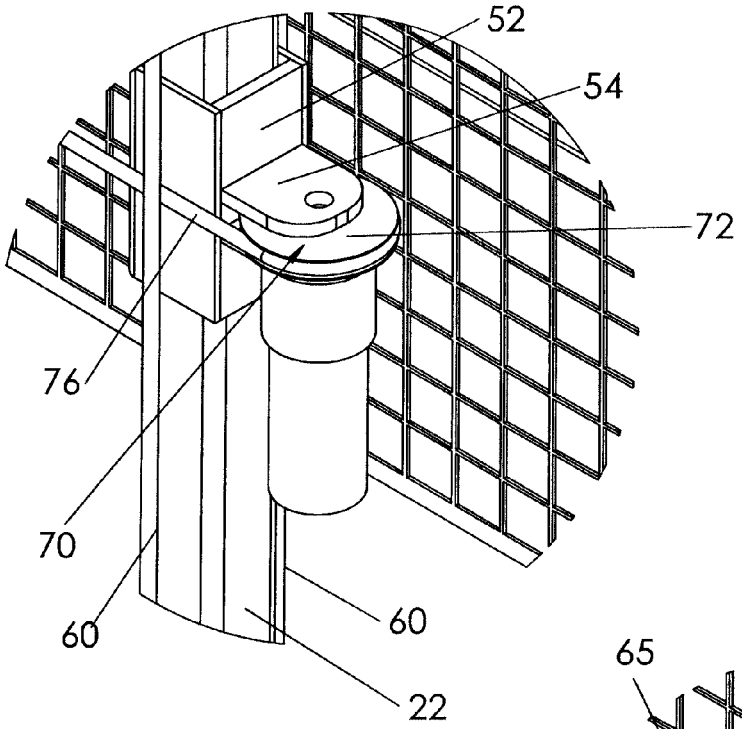
FIG. 4*a* is an isolated view on an enlarged scale taken from a portion of FIG. 2.
Figure 4B:
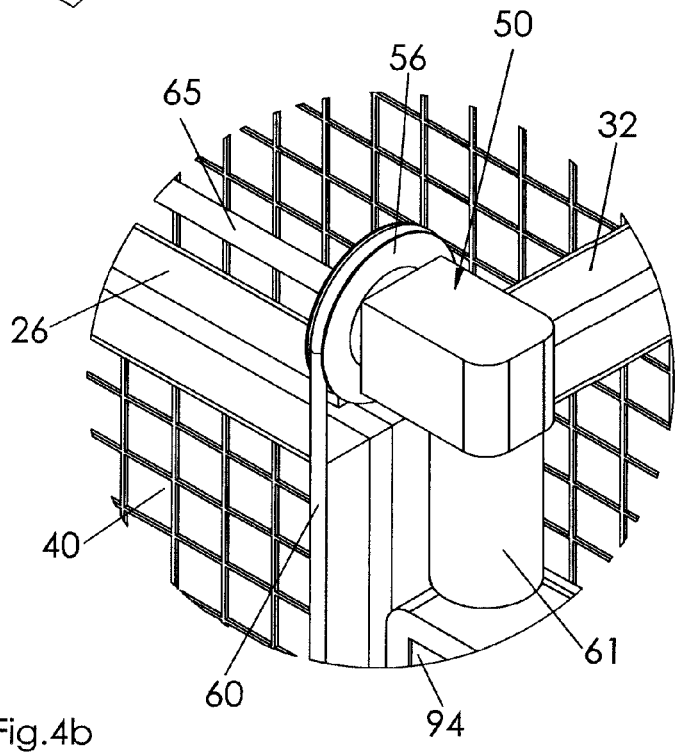
FIG. 4*b* is an isolated view on an enlarged scale taken from a portion of FIG. 2.
Figure 5:
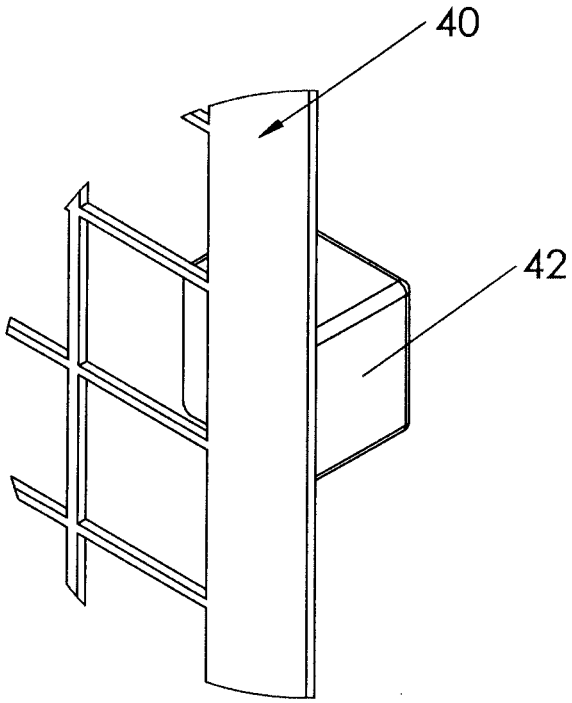
FIG. 5 is an isolated view on an enlarged scale taken from a portion of FIG. 2.
Figure 6A:
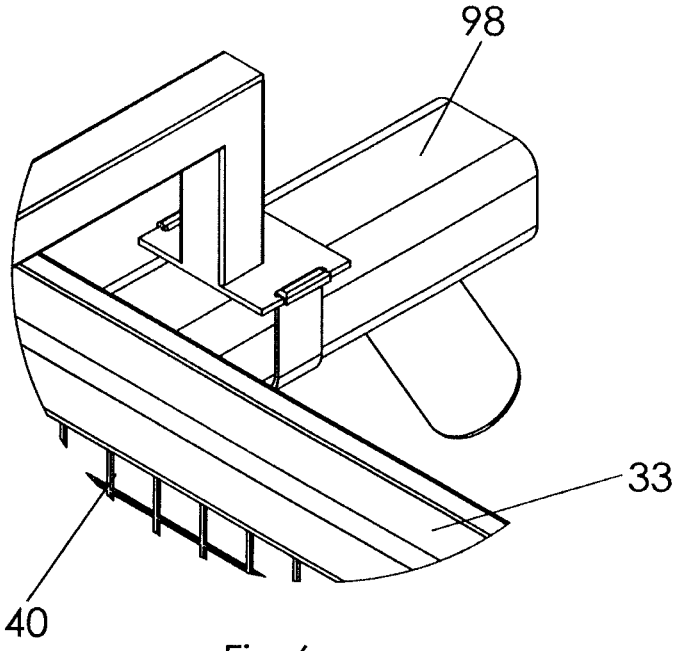
FIG. 6*a* is an isolated view on an enlarged scale taken from a portion of FIG. 2.
Figure 6B:
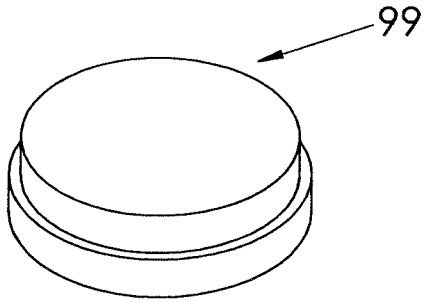
FIG. 6*b* is an isolated view on an enlarged scale taken from a portion of FIG. 2.
Figure 7:
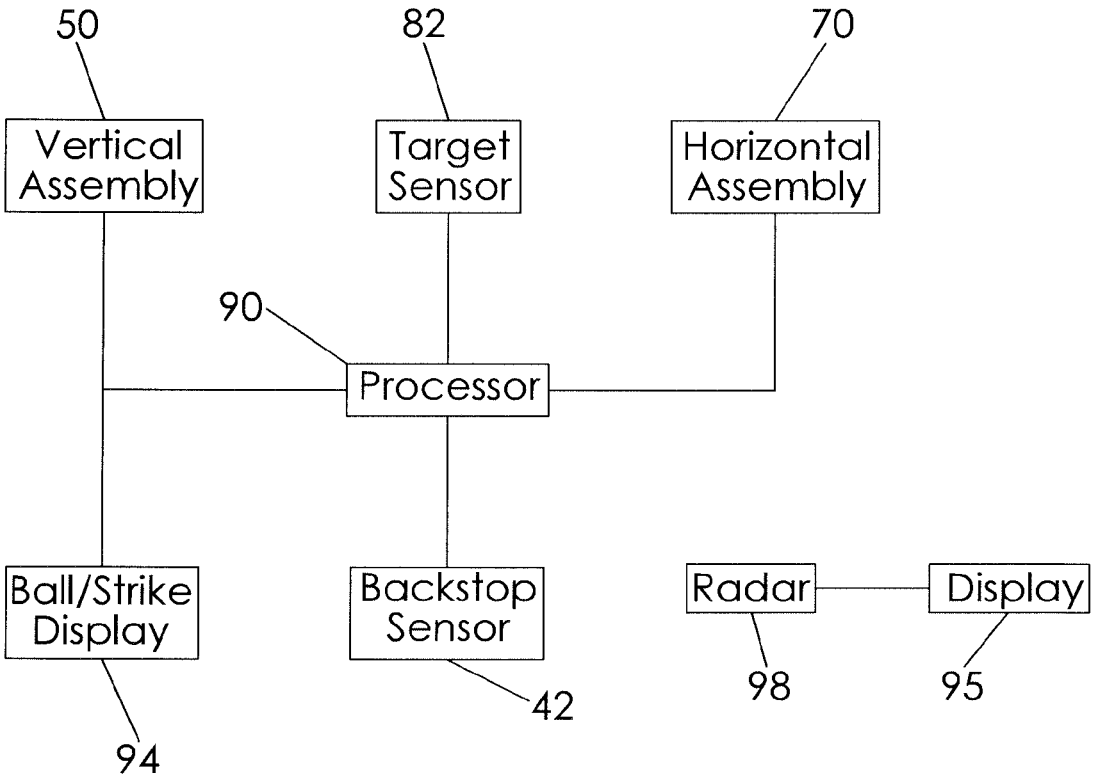
FIG. 7 is a block diagram illustrating the electronic components of the baseball pitching simulator according to the present invention.

Each first carriage 52 and second carriage 62 may include a respective flange 54 attached to outer side surface thereof that extends outwardly (FIG. 4*a*). The second assembly first pulley 72 may be coupled to the flange 54. Further, the second motor 78 may be coupled to the second adjustment assembly second pulley 74 so as to actuate the second adjustment assembly first pulley 72 when the second motor 78 is energized.

The second adjustment assembly 70 includes a pitching target 80 positioned and configured to be moved laterally between the first 22 and second 24 vertical support members. More particularly, the pitching target 80 is fixedly attached to the second adjustment assembly cable 76 such that the pitching target 80 is moved when the cable is moved. In other words, if the cable 76 is moved laterally to the right, the pitching target 80 is moved laterally to the right as well.

The baseball pitching simulator 10 includes a processor 90 in data communication with the first 50 and second 70 adjustment assemblies and, more particularly, in data communication with the first 61 and second 78 motors which operate the adjustment assemblies. A memory (not shown or numbered) is in data communication with the processor 90 and is configured to store programming instructions. As will be described in even more detail later, the memory includes programming that when executed by the processor 90 causes the first motor 61 to be energized to move the first carriage 52 a distance along the first vertical support member 22. Specific programming causes the processor 90 to determine which direction and how much movement is appropriate. The determined amount may be a random direction and distance. Further, programming causes the processor 90 to energize the second motor 78 to move the pitching target 80 a lateral direction and distance relative to the first 22 and second 24 vertical support members. Again, the direction and distance may be random. The conditions under which the programming is executed will be described below.

The pitching target 80 may include a pressure sensor 82 in data communication with the processor 90. It is understood that the communication between the pressure sensor 82 and processor 90 may be by electrical wire, circuitry, radio signal, or the like. The pressure sensor 82 is configured to detect when an impact force is experienced that is indicative of being struck by a thrown baseball. The outer surface of the pitching target 80 may have a gently padded construction configured to receive rather than deflect an impact by a ball.

A vibration sensor 42 may be positioned adjacent, proximate, or in direct physical contact with the backstop 40. The vibration sensor 42 is in data communication with the processor 90, such as by wire or wireless signal. The vibration sensor 42 is configured to detect a vibration in the backstop that is indicative that the backstop 40 has been impacted, such as by a thrown baseball.

Further, the baseball pitching simulator 10 may include an electronic display 94 in data communication with the processor 90 and memory. In some embodiments, the display 94 and other electronic components may be positioned together in the display housing. The memory includes programming that when executed by the processor 90 calculates and stores pitch count data so as to keep track of which throws (i.e. a pitch) impact the pitching target—a "strike"—and which throws impact the backstop—"a ball"—. Specifically, a pitch is logged in the pitch count data as a "strike" when the pressure sensor 82 detects an impact force; a pitch is logged in the pitch count data as a "ball" when the vibration sensor 42 detects an impact force. Programming may be executed by the processor 90 that causes the pitch count data to be transferred to and rendered by the display 94.

Figure 8:
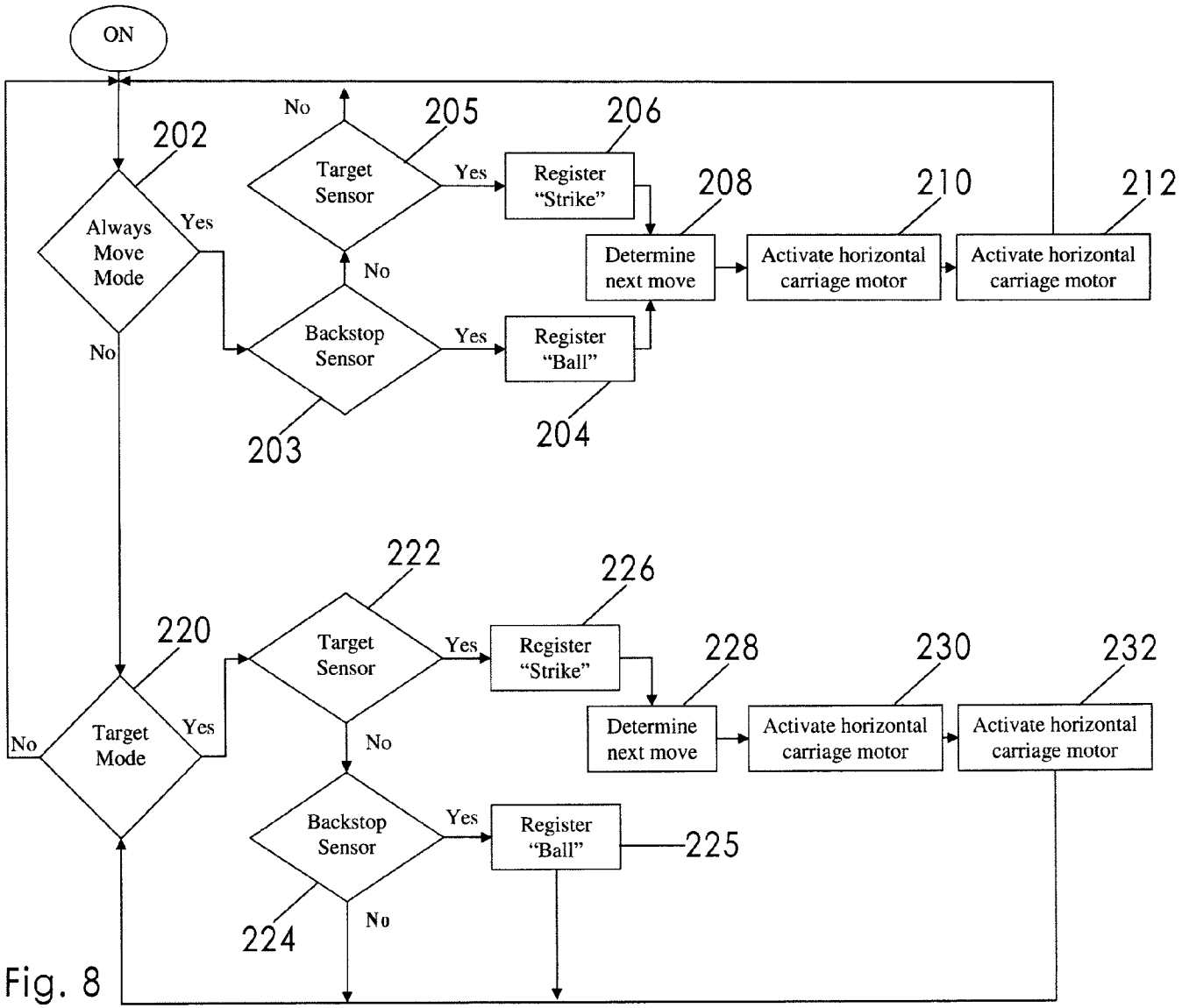
FIG. 8 is a flowchart illustrating the logic performed by the processor according to the present invention.

FIG. 8 illustrates an exemplary process 200 according to programming executed by the processor 90 in use of the baseball pitching simulator 10. First, a mode selection input 96 is operable by a user to determine what mode of operation will be followed by the processor 90. In some embodiments, the mode selection input 96 may be a button on the display 94 that is in data communication with the processor 90. At step 202, the processor 90 determines if a user has selected an "Always Move Mode" in which the processor determines first adjustment assembly movement instructions and second adjustment assembly movement instructions when either one of the vibration sensor 42 or the pressure sensor 82 detects an impact force. If so, then the process 200 proceeds to step 203; otherwise, the process 200 proceeds to step 220. At step 203, the processor 90 determines if the backstop/vibration sensor 42 has detected an impact and, if so, proceeds to step 204; otherwise, the process 200 proceeds to step 205. At step 204, the processor 90 causes the pitch count data to reflect a "ball" and process 200 is passed on to step 208. At step 205, the processor 90 determines if the pitching target pressure sensor 82 has detected an impact and, if so, proceeds to step 206; otherwise, the process 200 returns to step 202. At step 206, the processor 90 causes the pitch count data to reflect a "strike" and process 200 proceeds on to step 208.

At step 208, the processor 90 determines the next moves to be made by both the first 50 and second 70 adjustment assemblies. More particularly, the processor 90 determines both the direction and distance that will result from an energizing of the first motor 61 and second motor 78. The process 200 then proceeds to steps 210 and 212 where the processor 200 causes the first/vertical adjustment assembly motor 61 and the second/horizontal adjustment assembly motor 78 to be energized according to the movement signals determined by the processor 90 at step 208. Then, the process 200 returns to step 202 to re-evaluate the mode and actions to be taken.

At step 220, the processor 90 determines if a "Target Mode" has been selected by a user, in which in which the processor 90 determines first adjustment assembly movement instructions and second adjustment assembly movement instructions only when the pressure sensor 82 detects an impact force. If so, then the process 200 proceeds to step 222; otherwise, the process 200 returns to step 202. At step 222, the processor 90 determines if the pitching target pressure sensor 82 has detected an impact force. If so, the process 200 proceeds to step 226; otherwise, the process 200 proceeds to step 224.

At step 224, the processor 90 determines if the backstop vibration sensor 42 has detected an impact force. If so, the process 200 proceeds to step 225; otherwise, the process 200 returns to step 220. At step 225, the processor 90 causes the pitch count data to reflect a "ball" and process 200 is returned to step 220 (without energizing either of the adjustment assemblies).

At step 226, the processor 90 causes the pitch count data to reflect a "strike" and process 200 proceeds on to step 228. At step 228, the processor 90 determines the next moves to be made by both the first 50 and second 70 adjustment assemblies. More particularly, the processor 90 determines both the direction and distance that will result from an energizing of the first motor 61 and second motor 78. The process 200 then proceeds to steps 230 and 232 where the processor 200 causes the first/vertical adjustment assembly motor 61 and the second/horizontal adjustment assembly motor 78 to be energized according to the movement signals determined by the processor 90 at step 220.

The baseball pitching simulator 10 may also include a speed detection unit 98 removably coupled to the framework 20, the speed detection unit 98 also referred to as a radar gun. The speed detection unit 98 is in data communication with the processor 90 so that speed data may be received by the processor 90. The speed detection unit 98 is positioned generally inline with the pitching target 80 so as to measure the speed of balls being thrown/pitched toward the pitching target 80. The processor 90 may execute programming that causes the speed data to be transmitted to the display 94 (or to another display 95 (FIG. 7)). In addition, the speed detection unit 98 may include a wireless foot switch 99 for resetting or otherwise controlling the unit.

In use, a user may pitch balls toward the pitching simulator 10 in an attempt to hit the pitching target 80 to simulate pitching to a catcher's glove. In doing so, a user may simulate an actuate dual against a batter. Depending on the mode setting, the pitching target may move randomly after each pitch or only when the pitching target 80 is actually struck as described above.

It is understood that while certain forms of this invention have been illustrated and described, it is not limited thereto except insofar as such limitations are included in the following claims and allowable functional equivalents thereof.

The invention claimed is:

1. A baseball pitching simulator for simulating a live pitcher-hitter dual, comprising:

a framework including first and second vertical support members having upper and lower ends and including a top support member extending between said first and second vertical support member upper ends;

a first adjustment assembly, including:

a first carriage coupled to said first vertical support member and configured to move therealong;

a first motor operatively connected to first carriage and configured to move said first carriage vertically along said first vertical support member when said first motor is actuated;

a second adjustment assembly coupled to said first carriage and extending between said first and second vertical support members, said second adjustment assembly being moved between respective upper and lower ends of said first and second vertical support members when said first carriage is moved along said first vertical support member;

wherein said second adjustment assembly includes a pitching target;

wherein said second adjustment assembly includes a second motor operatively connected to said pitching target and configured to move said pitching target laterally between said first and second vertical support members when said second motor is actuated;

a processor in data communication with said first and second adjustment assemblies;

a memory in data communication with said processor, said memory including programming configured to control said processor when executed thereby;

programming that when executed by said processor causes said first motor to be energized to move said first carriage a random distance along said first vertical support member; and programming that when executed by said processor causes said second motor to be energized to move said pitching target a random distance laterally between said first and second vertical support members.

2. The baseball pitching simulator as in claim 1, further comprising:

an upper support structure attached to said first and second vertical support member upper ends, respectively, and extending rearwardly;

a lower support structure attached to said first and second vertical support member lower ends, respectively, and extending rearwardly;

a backstop coupled to said upper net support structure and extending downwardly substantially to said lower support structure; and a vibration sensor positioned in data communication with said backstop and said processor, said vibration sensor configured to detect an impact force against said backstop indicative of a baseball striking said backstop.

3. The baseball pitching simulator as in claim 2, wherein said backstop is a net having a generally flexible construction.

4. The baseball pitching simulator as in claim 2, wherein said pitching target includes a pressure sensor in data communication with said processor, said pressure sensor being configured to detect an impact force indicative of said pitching target being impacted by a baseball.

5. The baseball pitching simulator as in claim 1, wherein said first adjustment assembly includes:

first adjustment assembly upper and lower pulleys operatively mounted to respective upper and lower ends of said first vertical support member;

a first adjustment assembly cable having a continuous loop construction operatively coupled to and extending between said first adjustment assembly upper and lower pulleys, said first adjustment assembly cable being fixedly connected to said first carriage and electrically connected to said first motor; and wherein said first carriage is movable along said first vertical support member by operation of said first adjustment assembly upper and lower pulleys when said first motor is energized.

6. The baseball pitching simulator as in claim 5, wherein said second adjustment assembly includes:

a second adjustment assembly first pulley coupled to said first adjustment assembly first carriage and a second adjustment assembly second pulley positioned adjacent said second vertical support member opposite said first carriage;

a second adjustment assembly cable having a continuous loop construction operatively coupled to and extending between said second adjustment assembly first and second pulleys, said second adjustment assembly cable being fixedly connected to said pitching target and electrically connected to said second motor; and wherein said pitching target is laterally movable between said first and second vertical support members when said second motor is energized.

7. The baseball pitching simulator as in claim 6, wherein said first adjustment assembly includes:

a second carriage mounted to said second vertical support member and configured to move therealong;

auxiliary first adjustment assembly upper and lower pulleys operatively mounted to respective upper ends of said second vertical support member, an auxiliary first adjustment assembly cable having a continuous loop construction operatively coupled to and extending between said auxiliary first adjustment assembly upper and lower pulleys, said auxiliary first adjustment assembly cable being attached to said second carriage;

a first adjustment assembly connector rod extending between said first adjustment assembly upper pulley and said auxiliary first adjustment assembly upper pulley and configured such that said auxiliary first adjustment assembly upper pulley is rotated when said first adjustment assembly upper pulley is operated and such that said first carriage and said second carriage are moved together.

8. The baseball pitching simulator as in claim 7, wherein said second adjustment assembly second pulley is operatively mounted to said second carriage.

9. The baseball pitching simulator as in claim 5, wherein said first motor is operatively coupled to said first adjustment assembly upper pulley.

10. The baseball pitching simulator as in claim 9, wherein said second motor is operatively coupled to said second adjustment assembly first pulley.

11. The baseball pitching simulator as in claim 7, wherein:

said first carriage includes a flange attached to an outer side surface thereof and extending outwardly;

said second adjustment assembly first pulley is rotatably mounted to said first carriage flange; and said second motor is electrically connected to said second adjustment assembly first pulley and configured to rotate said second adjustment assembly first pulley when energized.

12. The baseball pitching simulator as in claim 4, further comprising:

an electronic display in data communication with said processor;

programming that when executed by said processor stores pitch count data in said memory indicative that a pitch is a "ball" when said vibration sensor detects an impact force and that a pitch is a strike when said pressure sensor detects an impact force; and programming that when executed by said processor transmits said pitch count data to said display.

13. The baseball pitching simulator as in claim 12, further comprising:

programming that when executed by said processor causes said processor to determine first adjustment assembly movement signals and second adjustment assembly signals after one of said vibration sensor or said pressure sensor has detected an impact force;

programming that when executed by said processor causes said first motor to be energized according to said first adjustment assembly movement signals; and programming that when executed by said processor causes said second motor to be energized according to said second adjustment assembly movement signals.

14. The baseball pitching simulator as in claim 12, further comprising:

programming that when executed by said processor causes said processor to determine first adjustment assembly movement signals and second adjustment assembly signals after said pressure sensor has detected an impact force;

programming that when executed by said processor causes said first motor to be energized according to said first adjustment assembly movement signals; and programming that when executed by said processor causes said second motor to be energized according to said second adjustment assembly movement signals.

15. The baseball pitching simulator as in claim 12, further comprising a mode selection input in data communication with said processor that is configured to enable a user to select an "Always Move Mode" in which said processor determines said first adjustment assembly movement instructions and said second adjustment assembly movement instructions when either one of said vibration sensor or said pressure sensor detects an impact force and to select a "Target Mode" in which said processor determines said first adjustment assembly movement instructions and said second adjustment assembly movement instructions only when said pressure sensor detects an impact force.

16. The baseball pitching simulator as in claim 12, further comprising:

a speed detection unit mounted to said framework and in data communication with said processor and said display; and programming that when executed by said processor causes a speed detected by said speed detection unit to be rendered on said display.

17. The baseball pitching simulator as in claim 16, wherein:

said speed detection unit is removably coupled to said framework; and said speed detection unit is positioned rearward of and generally inline with said pitching target.

18. The baseball pitching simulator as in claim 15, further comprising:

a speed detection unit removably mounted to said framework and in data communication with said processor and said display;

programming that when executed by said processor causes a speed detected by said speed detection unit to be displayed on said display; and wherein said speed detection unit is positioned rearward of and generally inline with said pitching target.

* * * * *